US005435760A

United States Patent [19]

Miklos

[11] Patent Number: 5,435,760

[45] Date of Patent: Jul. 25, 1995

[54] SELF-SEATING CONNECTOR ADAPTER

[75] Inventor: Alan R. Miklos, Paso Robles, Calif.

[73] Assignee: Sunbank Electronics, Inc., Paso Robles, Calif.

[21] Appl. No.: 377,488

[22] Filed: Jan. 24, 1995

Related U.S. Application Data

[63] Continuation of Ser. No. 113,262, Aug. 27, 1993, abandoned.

[51] Int. Cl.[6] ..... H01R 4/38

[52] U.S. Cl. ..... 439/321; 439/321; 439/470; 439/905

[58] Field of Search ..... 439/312, 320, 321, 323, 439/469, 470, 472, 904, 905

[56] References Cited

U.S. PATENT DOCUMENTS

| | | | |
|---|---|---|---|
| 3,352,342 | 11/1967 | Jacobson | 151/21 |
| 3,412,772 | 11/1968 | Meyfarth et al. | 151/21 |
| 3,880,490 | 4/1975 | Belmont . | |
| 4,165,910 | 8/1979 | Anderson . | |
| 4,213,664 | 7/1980 | McClenan . | |
| 4,285,564 | 8/1981 | Spinner | 439/321 |
| 4,407,529 | 10/1983 | Holman | 439/321 X |
| 4,462,653 | 7/1984 | Flederbach et al. | 439/321 X |
| 4,487,470 | 12/1984 | Knapp et al. . | |
| 4,497,530 | 2/1985 | Shannon . | |
| 4,699,552 | 10/1987 | Jeal | 411/43 |
| 4,808,123 | 2/1989 | Dee et al. | 439/470 |
| 4,863,396 | 9/1989 | Johnson | 439/470 |
| 4,984,995 | 1/1991 | Tucker et al. | 439/470 X |
| 5,035,640 | 7/1991 | Drogo | 439/321 |
| 5,082,454 | 1/1992 | Tonkiss et al. | 439/320 |
| 5,192,219 | 3/1993 | Fowler et al. | 439/321 |

*Primary Examiner*—Khiem Nguyen

*Attorney, Agent, or Firm*—Marshall, O'Toole, Gerstein, Murray & Borun

[57] ABSTRACT

A self-seating backshell includes a backshell body, a coupling ring, and a spring. The backshell body has a first plurality of teeth. The coupling ring is mounted on the backshell body for coupling the backshell body to an electrical connector. The electrical connector has a second plurality of teeth. The first plurality of teeth are arranged to seat against the second plurality of teeth. A spring retains the coupling ring on the backshell body and biases the first plurality of teeth into seating engagement against the second plurality of teeth even though the first plurality of teeth initially are not properly seated against the second plurality of teeth.

37 Claims, 3 Drawing Sheets

SELF-SEATING CONNECTOR ADAPTER

This is a continuation of U.S. application Ser. No. 08/113,262, filed Aug. 27, 1993, now abandoned.

FIELD OF THE INVENTION

The present invention relates to a self-seating connector adapter and, more particularly, to a self-seating connector adapter which is arranged to assure proper seating to a corresponding electrical connector.

BACKGROUND OF THE INVENTION

An electrical connector is frequently used to terminate a multi-conductor electrical cable. The electrical connector may be either a male or female plug or receptacle, and the conductors of the multi-conductor electrical cable are terminated to contacts of the electrical connector. This connector is arranged to electrically mate with a corresponding connector of an electrical apparatus. Furthermore, a connector adapter, such as a backshell having a backshell body and a coupling ring, is frequently used in combination with an electrical connector and its associated multi-conductor electrical cable. The coupling ring of the backshell is arranged to couple the backshell body to the electrical connector.

Backshells are formed in various configurations, such as elbows, and are arranged to perform one or more various functions, depending upon their particular application. In an example of one application, electrical connectors having backshells coupled thereto are used extensively for the interconnection of an aircraft's various control and/or instrumentation functions. This application requires such electrical connectors to be shielded from electromagnetic interference and to withstand substantial dynamic forces such as those arising from vibration, shock, bending, and temperature cycling. If electrical connectors are not properly shielded, electromagnetic interference can result in undesirable and potentially dangerous disruptions of the control and/or instrumentation functions of an aircraft. Similarly, if strain relief is not provided, dynamic forces can cause strain on the electrical conductors which, in turn, can cause dislocation of the pins of the electrical connectors resulting in a disruption or loss of an aircraft's control and/or instrumentation functions. Backshells have been arranged to provide electromagnetic interference shielding and strain relief for such electrical connectors and conductors.

The coupling ring and the backshell body of a typical backshell are arranged so that the coupling ring is held captive to the backshell body. Accordingly, once the backshell is assembled, the coupling ring cannot easily be removed from the backshell body. The backshell may be provided with an anti-rotation device in order to prevent rotation between the backshell and the electrical connector to which it is coupled. The backshell may also be provided with an anti-rotation mechanism between the backshell body and the coupling ring.

Unfortunately, if a typical prior art backshell is improperly seated against a corresponding electrical connector, the backshell can disengage from the electrical connector. If the backshell disengages from the electrical connector, dynamic forces can cause the backshell to move and twist with respect to the electrical connector permitting dislocation of pins of the electrical connector. If the pins dislocate, these pins may break the electrical connection between the electrical connector and a corresponding electrical connector to which it is coupled. Also, electromagnetic interference can propagate between the backshell and the electrical connector and can intrude into the interior of the backshell where it may interfere with the electrical signals carried by the electrical connector.

Precautions have been taken in the past in order to preclude such unintentional relative movement between the backshell and its corresponding connector. For example, safety wires have been attached to both the coupling ring of the backshell and the corresponding electrical connector, and are intended to lock the backshell to the electrical connector so that relative movement therebetween is prevented. Set screws and thread locking compounds have also been used between the backshell and its corresponding electrical connector in order to prevent such relative movement. These arrangements, however, increase the cost of manufacturing and installing electrical fittings.

Moreover, even though the correct amount of coupling torque is applied by an installer to the coupling ring of a prior art backshell, this backshell may be improperly seated against its corresponding electrical connector. Consequently, the installer may falsely believe that the backshell is properly seated because the coupling "feels" tight (i.e., the installer applied the correct amount of coupling torque to the coupling ring). However, because the backshell and the electrical connector are improperly seated against one another, the coupling between the backshell and the electrical connector can loosen. If this coupling loosens enough, the backshell may no longer provide the necessary shielding thereby allowing electromagnetic interference to intrude into the backshell and interfere with the electrical signals carried by the connector. This interference can disrupt the control and/or instrumentation functions of the electrical apparatus to which the electrical connector is connected. Also, the pins of the electrical connector can dislocate sufficiently to disrupt these control and/or instrumentation functions.

SUMMARY OF THE INVENTION

Unlike prior art connector adapters, the connector adapter of the present invention is self-seating in order to assure proper seating between the connector adapter and a corresponding electrical connector. The self-seating connector adapter of the present invention thereby reduces the likelihood of a disengagement between the connector adapter and the electrical connector to which it is coupled.

Accordingly, in one aspect of the present invention, a self-seating connector adapter includes a an adapter body, a coupling means, and a biasing means. The coupling means couples the adapter body to an electrical connector. The biasing means cooperates with the adapter body and the coupling means in order to bias the adapter body into proper seating engagement against the electrical connector even though the adapter body initially is not properly seated against the electrical connector.

In another aspect of the present .invention, a self-seating connector adapter includes an adapter body, a coupling means, and a biasing means. The adapter body has first engaging elements thereon. The coupling means is arranged to couple the adapter body to an electrical connector. The electrical connector has second engaging elements thereon, and the first engaging elements are arranged to seat against the second engaging elements. The biasing means cooperates with both the adapter body and the coupling means in order to bias the first engaging elements into seating engagement against the second engaging elements even though the first engaging elements of the adapter body initially are not seated against the second engaging elements of the electrical connector.

In accordance with yet another aspect of the invention, a self-seating connector adapter includes a backshell body, a coupling ring, and a spring. The backshell body has a first plurality of teeth. The coupling ring is mounted on the backshell body and is arranged to couple the backshell body to an electrical connector. The electrical connector has a second plurality of teeth, and the first plurality of teeth are arranged to seat against the second plurality of teeth. The spring is arranged to retain the coupling ring on the backshell body and to bias the backshell body toward the electrical connector so that the first plurality of teeth seat against the second plurality of teeth even though the first plurality of teeth initially are not properly seated against the second plurality of teeth.

In a still further aspect of the invention, a self-seating electrical adapter includes an adapter body, a coupling means, and a biasing means. The coupling means couples the adapter body to an electrical apparatus. The biasing means cooperates with the adapter body and the coupling means in order to bias the adapter body into proper seating engagement against the electrical apparatus even though the adapter body initially is not properly seated against the electrical apparatus.

BRIEF DESCRIPTION OF THE DRAWING

These and other features and advantages will become more apparent from a detailed consideration of the invention when taken in conjunction with the drawing in which.

DETAILED DESCRIPTION OF THE INVENTION

Figure 1:
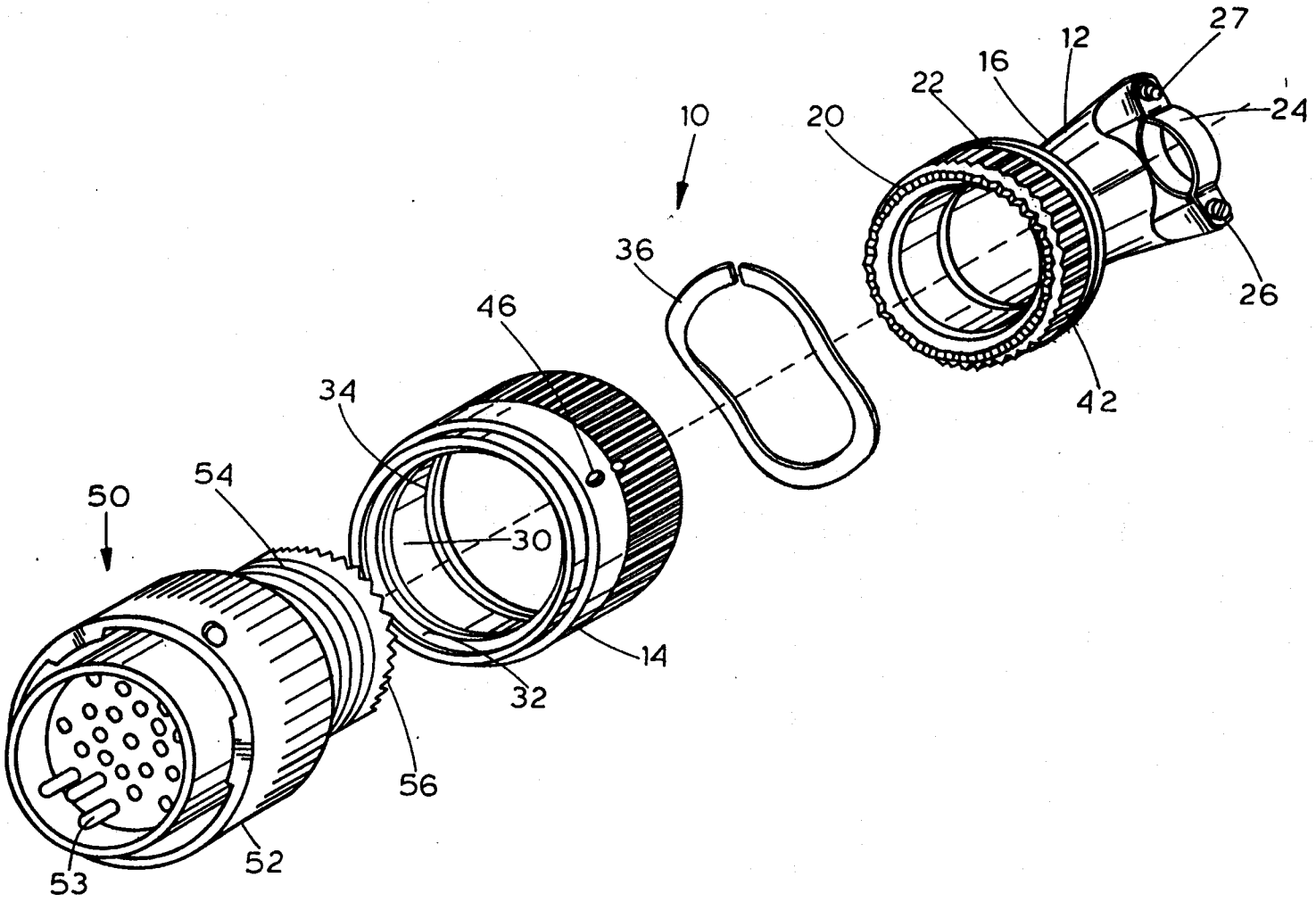
FIG. 1 is an exploded perspective view of the self-seating connector adapter according to the present invention and an electrical connector for coupling thereto.
Figure 2:
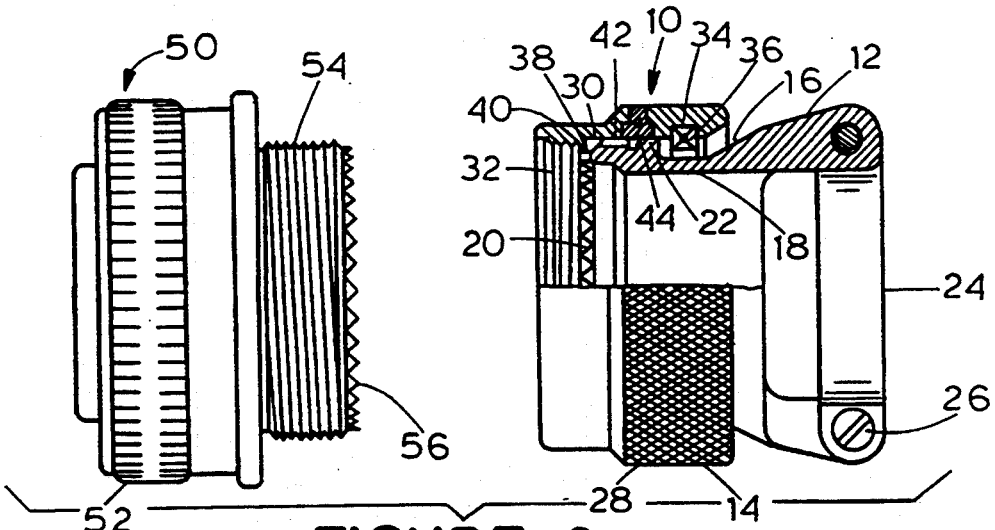
FIG. 2 is a partial cross-sectional side view of the self-seating connector adapter, and a side view of the electrical connector, shown in FIG. 1, wherein the electrical connector is positioned to receive the self-seating connector adapter.

As shown in FIGS. 1 and 2, a self-seating connector adapter or backshell 10 includes a backshell body 12 and a coupling ring 14. The backshell body 12 has an outer perimeter 16 and an inner perimeter 18. The inner perimeter 18 of the backshell body 12 forms a cavity through which electrical conductors (not shown) of a multi-conductor cable may be inserted and may be terminated at an electrical connector such as a male or female plug or receptacle.

The backshell body 12 has a first plurality of engaging elements 20 which, as shown in the drawing, may be in the form of serrations or teeth, although any other suitable form is possible. Around the outer perimeter 16 of the backshell 18 is a flange 22. The backshell body 12 also includes a saddle clamp 24 which can be utilized to clamp the electrical conductors inserted through the cavity formed by the inner perimeter 18 in order to provide strain relief between such electrical conductors and an electrical connector to which the electrical conductors are terminated. For this purpose, the saddle clamp 24 has one or more screws, such as the screw 26, and one or more corresponding self-locking nuts, such as the nut 27. These screws are tightened into their corresponding nuts in order to clamp the saddle clamp 24 about the electrical conductors passing therethrough. The electrical conductors clamped by the saddle clamp 24 are terminated to an electrical connector which is coupled to the backshell body 12.

The coupling ring 14 includes an outer perimeter 28 and an inner perimeter 30. As shown, the outer perimeter 28 of the coupling ring 14 may be knurled in order to facilitate the turning of the coupling ring onto an electrical connector. The inner perimeter 30 of the coupling ring 14 may have threads 32 and a recess 34 therearound. The recess 34 accommodates a wave spring 36. The inner perimeter 30 of the coupling ring 14 also has a step 38 to provide a flange 40.

Around the outer perimeter 16 of the backshell body 12 are a plurality of gear-like teeth 42. A clip 44 is press fit into a corresponding hole 46 in the coupling ring 14. The clip 44 is desirably formed of a resilient material with spring memory. The clip 44, when engaged with the teeth 42, provides a resistance to relative movement between the coupling ring 14 and the backshell body 12 during and after coupling of the connector adapter 10 to an electrical connector.

During assembly of the connector adapter 10, the wave spring 36 is slipped over the outer perimeter 16 of the backshell body 12. The backshell body 12 is then inserted into the coupling ring 14. Interference between the teeth 42 around the outer perimeter 16 of the backshell body 12 and the flange 40 around the inner perimeter 30 of the coupling ring 14 ensures that the backshell body 12 cannot pass entirely through the coupling ring 14 as the backshell body 12 is inserted into the coupling ring 14. After the flange 22 around the outer perimeter 16 of the backshell body 12 has been inserted past the recess 34 around the inner perimeter 30 of the coupling ring 14, the wave spring 36 is pressed into the recess 34. Interference between the flange 22 and the wave spring 36 ensures that the backshell body 12 cannot slip back out of the coupling ring 14. Accordingly, the coupling ring 14 is captured on the backshell body 12 so that the coupling ring 14 and the backshell body 12 cannot be easily separated.

An electrical connector 50 is also shown in FIG. 1. The electrical connector 50 includes a connector housing 52 for housing a plurality of connector elements such as male pins 53. These connector elements can alternatively be female sockets. The electrical connector 50 further includes threads 54 which are arranged to cooperate with the threads 32 of the coupling ring 14. The electrical connector 50 includes a second plurality of engaging elements 56 which, as shown in the drawing, may be in the form of serrations or teeth, although any other suitable form is possible as long as the second plurality of engaging elements are arranged to mesh with the first plurality of engaging elements 20. When the first and second pluralities of engaging elements are properly seated against one another, relative rotation between the coupling ring 14 and the electrical connector 50 is prevented.

Figure 3:
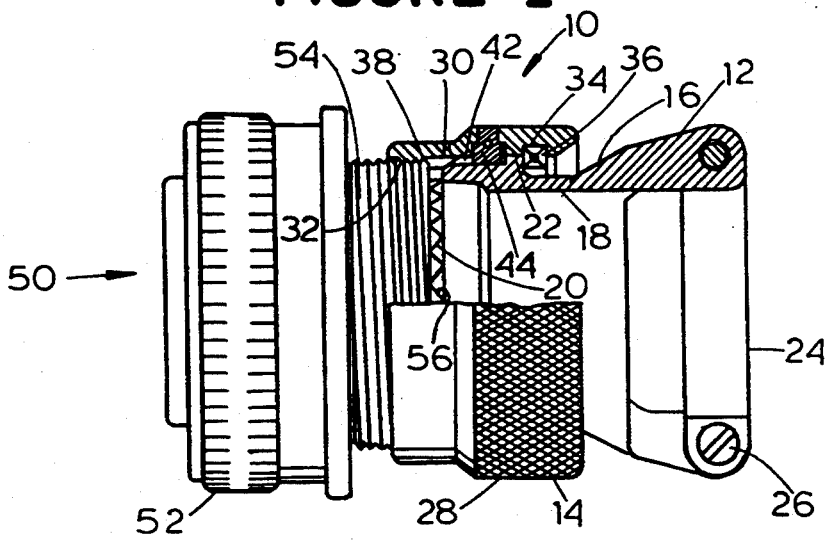
FIG. 3 is a partial cross-sectional side view of the self-seating connector adapter, and a side view of the electrical connector, shown in FIG. 1, wherein the self-seating connector adapter is partially threaded onto the electrical connector, and wherein an anti-rotation feature of the connector adapter is engaged.
Figure 4:
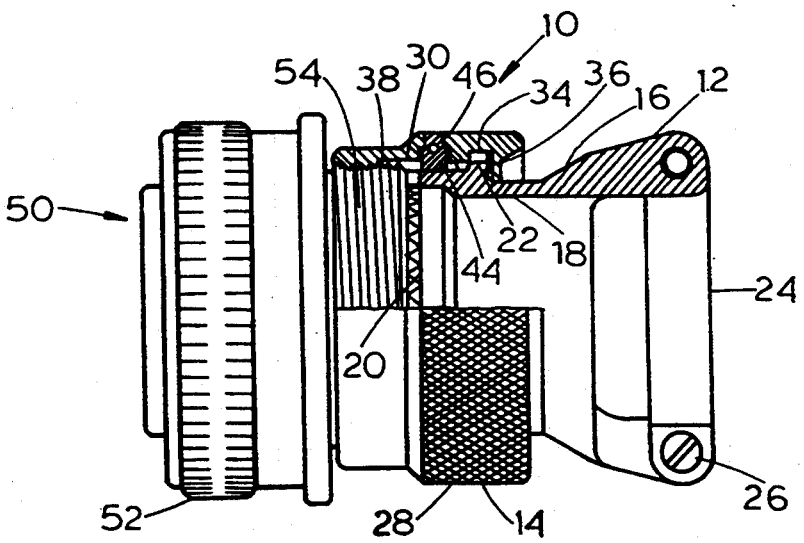
FIG. 4 is a partial cross-sectional side view of the self-seating connector adapter, and a side view of the electrical connector, shown in FIG. 1, wherein the self-seating connector adapter is shown fully torqued onto, and properly seated against, the electrical connector.

The manner of coupling the connector adapter 10 to the electrical connector 50 is shown in FIGS. 2–6. Prior to coupling, the conductors (not shown) terminated to the pins 53 are passed through the backshell body 12. Also, prior to coupling, as shown in FIG. 2, the coupling ring 14 is positioned in a free-spinning relationship with respect to the backshell body 12. Accordingly, the clip 44 does not engage the anti-rotation teeth 42 and the wave spring 36 is uncompressed. With the coupling ring 14 and the backshell body 12 in the position shown in FIG. 2, threading of the coupling ring 14 onto the electrical connector 50 is begun. When the first plurality of engaging elements 20 abut the second plurality of engaging elements 56, continued threading of the coupling ring 14 onto the electrical connector 50 causes relative movement between the coupling ring 14 and the backshell body 12 so that the clip 44 expands and engages the anti-rotation teeth 42 as shown in FIG. 3. The wave spring 36 is still uncompressed at this point. Then, the coupling ring 14 is fully torqued until the first plurality of engaging elements 20 on the backshell body 12 are fully seated against the second plurality of engaging elements 56 on the electrical connector 50, as shown in FIG. 4. At this point, the wave spring 36 is compressed. When the first and second pluralities of engaging elements 20 and 56 are properly seated against one another, relative rotation between the coupling ring 14 and the electrical connector 50 is prevented. Also, the engagement between the clip 44 and the anti-rotation teeth 42 inhibits relative rotation between the coupling ring 14 and the backshell body 12. The saddle clamp 24 is tightened around the conductors passing therethrough in order to provide strain relief between these conductors and the electrical connector 50. The electrical connector 50 is now ready for electrical connection to a corresponding second electrical connector such as by plugging the male pins 53 of the electrical connector 50 into female sockets of the corresponding second electrical connector.

Figure 5:
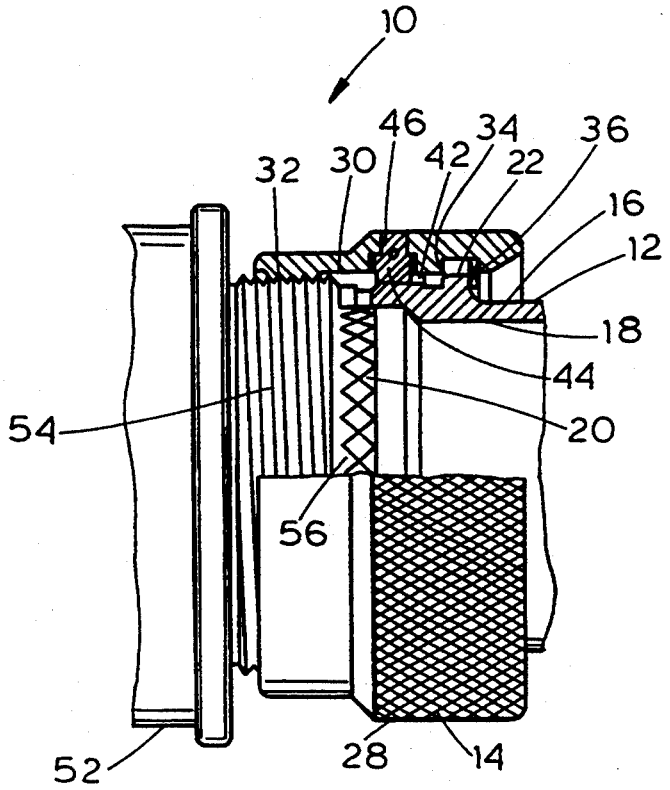
FIG. 5 shows a partial cross-sectional side view of the self-seating connector adapter, and a side view of the electrical connector, shown in FIG. 1, wherein the self-seating connector adapter is fully torqued onto, but improperly seated against, the electrical connector; and, FIG. 6 shows the proper seating of the self-seating connector adapter against the electrical connector shown in FIG. 5 as a result of the action of a biasing spring.

As shown in FIG. 5, the first and second pluralities of engaging elements 20 and 56 occasionally do not fully seat against each other even though full torque is applied to the coupling ring 14 in order to couple the connector adapter 10 to the electrical connector 50. As shown in FIG. 5, the wave spring 36 is fully compressed. If the first and second pluralities of engaging elements 20 and 56 do not fully seat against each other, it is possible for the coupling between the coupling ring 14 and the electrical connector 50 to loosen in the presence of dynamic forces. This loosening can permit relative movement between the backshell body 12 and the electrical connector 50.

Relative movement between the backshell body 12 and the electrical connector 50 can result in the dislocation of one or more of the pins 53 of the electrical connector 50 which, in turn, can result in an open circuit between the electrical connector 50 and the corresponding second electrical connector to which it is electrically coupled. This relative movement can also permit the intrusion of electromagnetic interference into the interior of the backshell body 12. This electromagnetic interference can interfere with the electrical signals carried by the conductors of the electrical connector 50.

Figure 6:
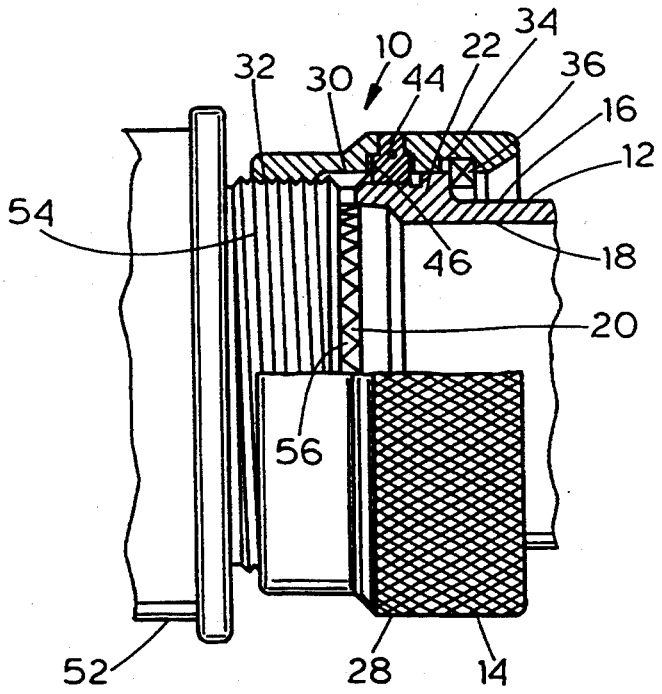

However, the compressed wave spring 36 exerts a force against the backshell body 12 in order to bias the backshell body 12 in the direction of the electrical connector 50 until the first and second pluralities of engaging elements 20 and 56 are fully seated, as shown in FIG. 6. Thus, as shown in FIG. 6, the wave spring 36 is only partially compressed due to movement of the backshell body 12 as the first plurality of engaging elements 20 properly and fully seat against the second plurality of engaging elements 56.

Accordingly, the self-seating feature of the present invention assures proper seating of the connector adapter 10 to the electrical connector 50 even though the connector adapter 10 initially is improperly seated against the electrical connector 50. The present invention eliminates the need for safety wiring, set screws, or thread locking compounds between the connector adapter 10 and the electrical connector 50 and, as a result, decreases the cost of manufacturing and installing connector adapters.

Certain modifications of the invention will be apparent to those skilled in the art. For example, instead of providing knurling on the coupling ring 14, the coupling ring 14 may be provided with a hexagonal shape to receive a crescent or similar installation wrench. The present invention can be used with or without the clip 44 and the anti-rotation teeth 42. Even if the clip 44 and the anti-rotation teeth 42 are not used, the force applied by the wave spring 36 causes rotation between the backshell body 12 and the coupling ring 14 to be resisted. The saddle clamp 44 need not be included in the connector adapter 10 if strain relief is not desirable. Other types of clamps may be provided in place of the saddle clamp 24 if strain relief is desirable. Although a wave spring 36 is preferable in order to capture the coupling ring 14 on the backshell body 12 and to bias the backshell body 12 into full seating engagement against the electrical connector 50 in the event of incorrect assembly, other forms of springs may be used. Other modifications also will be apparent to those skilled in the art. Accordingly, the present invention is to be limited only by the appended claims.

I claim:

1. A self-seating electrical adapter comprising:

an adapter body;

coupling means for coupling the adapter body to an electrical connector; and, biasing means cooperating with the adapter body and the coupling means for biasing the adapter body into proper seating engagement against the electrical connector even though the adapter body initially is not properly seated against the electrical connector and for preventing separation of the coupling means from the adapter body by interfering with the adapter body in first and second opposing directions.

2. The self-seating electrical adapter of claim 1 wherein one of the adapter body and the coupling means comprises a flange the flange and the biasing means being arranged to cooperate in order to capture the coupling means on the adapter body in the first opposing direction.

3. The self-seating electrical adapter of claim 2 wherein the biasing means comprises a wave spring.

4. The self-seating electrical adapter of claim 2 further comprising rotation resisting means for resisting rotation between the coupling means and the adapter body.

5. The self-seating electrical adapter of claim 4 wherein the rotation resisting means comprises rotation resisting elements on the adapter body and a clip on the coupling means, the rotation resisting elements being arranged so that, when the clip engages the rotation resisting elements, relative movement between the adapter body and the coupling means is resisted.

6. The self-seating electrical adapter of claim 5 wherein the rotation resisting elements comprise teeth arranged around a perimeter of the adapter body.

7. The self-seating electrical adapter of claim 6 wherein the biasing means comprises a wave spring.

8. The self-seating electrical adapter of claim 1 further comprising rotation resisting means for resisting rotation between the coupling means and the adapter body.

9. The self-seating electrical adapter of claim 8 wherein the rotation resisting means comprises rotation resisting elements on the adapter body and a clip on the coupling means, the rotation resisting elements being arranged so that, when the clip engages the rotation resisting elements, relative movement between the adapter body and the coupling means is resisted.

10. The self-seating electrical adapter of claim 9 wherein the rotation resisting elements comprise teeth arranged around a perimeter of the adapter body.

11. The self-seating electrical adapter of claim 1 wherein the biasing means comprises a wave spring.

12. The self-seating electrical adapter of claim 3 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

13. The self-seating electrical adapter of claim 7 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

14. The self-seating electrical adapter of claim 11 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

15. A self-seating electrical adapter comprising:

an adapter body having first engaging elements thereon;

coupling means for coupling the adapter body to an electrical connector, wherein the electrical connector has second engaging elements thereon, wherein the first engaging elements are arranged to seat against the second engaging elements, and wherein the adapter body and the coupling means are arranged without interference in at least a first direction such that the adapter body and the coupling means are separatable in the first direction; and, biasing means cooperating with the adapter body and the coupling means for biasing the first engaging elements into seating engagement with the second engaging elements even though the first engaging elements of the adapter body initially are not properly seated against the second engaging elements of the electrical connector and for preventing separation between the coupling means and the adapter body in the first direction.

16. The self-seating electrical adapter of claim 15 wherein one of the adapter body and the coupling means comprises a flange preventing separation of the coupling means from the adapter the flange and the biasing means being arranged to cooperate in order to capture the coupling means on the adapter body in the first direction.

17. The self-seating electrical adapter of claim 16 wherein the biasing means comprises a wave spring.

18. The self-seating electrical adapter of claim 16 further comprising rotation resisting means for resisting rotation between the coupling means and the adapter body.

19. The self-seating electrical adapter of claim 18 wherein the rotation resisting means comprises rotation resisting elements on the adapter body and a clip on the coupling means, the rotation resisting elements being arranged so that, when the clip engages the rotation resisting elements, relative movement between the adapter body and the coupling means is resisted.

20. The self-seating electrical adapter of claim 19 wherein the rotation resisting elements comprise teeth arranged around a perimeter of the adapter body.

21. The self-seating electrical adapter of claim 20 wherein the biasing means comprises a wave spring.

22. The self-seating electrical adapter of claim 15 further comprising rotation resisting means for resisting rotation between the coupling means and the adapter body.

23. The self-seating electrical adapter of claim 22 wherein the rotation resisting means comprises rotation resisting elements on the adapter body and a clip on the coupling means, the rotation resisting elements being arranged so that, when the clip engages the rotation resisting elements, relative movement between the adapter body and the coupling means is resisted.

24. The self-seating electrical adapter of claim 23 wherein the rotation resisting elements comprise teeth arranged around a perimeter of the adapter body.

25. The self-seating electrical adapter of claim 15 wherein the biasing means comprises a wave spring.

26. The self-seating electrical adapter of claim 17 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

27. The self-seating electrical adapter of claim 21 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

28. The self-seating electrical adapter of claim 25 wherein the wave spring has an outer perimeter, an inner perimeter, and first and second surfaces extending between the outer and inner perimeters, wherein the first and second surfaces are oppositely facing surfaces, wherein the coupling means has a recess to receive the outer perimeter of the wave spring, and wherein the first surface of the wave spring engages the adapter body in order to prevent separation of the coupling means from the adapter body in the first direction.

29. A self-seating backshell comprising:

a backshell body having a first plurality of teeth and having first and second ends;

a coupling ring mounted on the backshell body and arranged to couple the backshell body to an electrical connector, wherein the coupling ring has first and second ends, wherein the backshell body and the coupling ring are formed so that the first end of the backshell body may be inserted in a first direction through the second end of the coupling ring without interference, wherein the electrical connector has a second plurality of teeth, and wherein the first plurality of teeth are arranged to seat against the second plurality of teeth; and, a wave spring arranged to bias the backshell body toward the electrical connector so that the first plurality of teeth seat against the second plurality of teeth even though the first plurality of teeth initially are not properly seated against the second plurality of teeth, wherein the wave spring has an outer perimeter, an inner perimeter, and first and second surfaces extending between the outer and inner perimeters, wherein the first and second surfaces are oppositely facing surfaces, wherein the coupling ring has a recess to receive the outer perimeter of the wave spring, and wherein the first surface of the wave spring engages the backshell body in order to prevent separation of the coupling ring from the backshell body in a second direction which is substantially opposite to the first direction.

30. The self-seating backshell of claim 29 wherein the backshell body comprises a flange for preventing separation of the coupling ring from the backshell body in the first direction, and wherein the flange and the wave spring are arranged to cooperate in order to capture the coupling ring on the backshell body.

31. The self-seating backshell of claim 30 further comprising rotation resisting means for resisting rotation between the coupling ring and the backshell body.

32. The self-seating backshell of claim 31 wherein the rotation resisting means comprises rotation resisting elements on the backshell body and a clip on the coupling ring, the rotation resisting elements being arranged so that, when the clip engages the rotation resisting elements, relative movement between the backshell body and the coupling ring is resisted.

33. The self-seating backshell of claim 32 wherein the rotation resisting elements comprise teeth arranged around a perimeter of the backshell body.

34. The self-seating backshell of claim 29 further comprising rotation resisting means for resisting rotation between the coupling ring and the backshell body.

35. The self-seating backshell of claim 34 wherein the rotation resisting means comprises rotation resisting elements on the backshell body and a clip on the coupling ring, the rotation resisting elements being arranged so that, when the clip engages the rotation resisting elements, relative movement between the backshell body and the coupling ring is resisted.

36. The self-seating backshell of claim 35 wherein the rotation resisting elements comprise teeth arranged around a perimeter of the backshell body.

37. A self-seating electrical adapter comprising:

an adapter body;

coupling means for coupling the adapter body to an electrical connector; and, biasing means cooperating with the adapter body and the coupling means for biasing the adapter body into proper seating engagement against the electrical connector even though the adapter body initially is not properly seated against the electrical connector and for solely preventing separation of the coupling means from the adapter body in at least a first direction.

* * * * *

UNITED STATES PATENT AND TRADEMARK OFFICE

CERTIFICATE OF CORRECTION

PATENT NO. : 5,435,760

DATED : July 25, 1995

INVENTOR(S) : Alan R. Miklos

It is certified that errors appear in the above-identified patent and that said Letters Patent is hereby corrected as shown below:

In Column 7, claim 2, line 5, "flange" (first occurrence) should be --flange,--.

In Column 8, claim 16, line 30, "flange" should be --flange,--.

In Column 8, claim 16, lines 30-31, delete "preventing separation of the coupling means from the adapter".

Signed and Sealed this

Seventeenth Day of October, 1995

Bruce Lehman

*Attest:*

BRUCE LEHMAN

*Attesting Officer*

*Commissioner of Patents and Trademarks*